United States Patent [19]

Badon, Jr.

[11] 4,238,859

[45] Dec. 16, 1980

[54] SPILL-OVER SPA

[75] Inventor: Sterling P. Badon, Jr., Carencro, La.

[73] Assignee: Majestic Sales, Inc., Lafayette, La.

[21] Appl. No.: 52,837

[22] Filed: Jun. 28, 1979

[51] Int. Cl.[3] ..... E04H 3/18

[52] U.S. Cl. ..... 4/509; 4/492; 4/578

[58] Field of Search ..... 4/172, 172.15–172.17, 4/183, 189, 173 R, 173 M, 175, 181; 141/106, 364

[56] References Cited

U.S. PATENT DOCUMENTS

| | | | |
|---|---|---|---|
| 475,941 | 5/1892 | Hawkins | 4/183 X |
| 1,660,958 | 2/1928 | Gloekler | 4/189 |
| 1,728,502 | 9/1929 | McGregor | 4/189 |
| 3,801,992 | 4/1974 | Sable | 4/172.17 |
| 3,837,016 | 9/1974 | Schindler et al. | 4/172.17 |

*Primary Examiner*—Stuart S. Levy

[57] ABSTRACT

A spill-over type spa is disclosed for use with an existing swimming pool. Water enters the spill-over type spa in the usual manner, but is thereafter permitted to spill-over into the adjacent swimming pool via a transition section integrity formed with the spill-over spa. The transition section rests on an upper peripheral edge of the swimming pool, thereby permitting water within the spa to spill-over into the pool. The spa is placed adjacent an existing pool in a manner to preserve integrity of the existing pool wall, yet permit the spa to function with the pool.

3 Claims, 2 Drawing Figures

SPILL-OVER SPA

BACKGROUND OF THE INVENTION

Open-air spas are becoming a commonplace item in American homes and backyards, such spas designed to be positioned in close proximity with either indoor or outdoor family pools. Some of these spas include individual heaters and circulation systems for circulating hot water within. These hot water spas possess inherent therapeutic aspects and advantages in their ability to massage and relax strained muscles by surrounding the body with circulating hot water and by providing hot water pressure jets to direct streams of hot water directly onto the strained muscles. Hot water spas also provide simple physical relaxation and leisure time enjoyment for those not necessarily desiring physical therapy or a hot water massage of tired or strained muscles, but simple seeking to relax in the privacy in their home or backyard.

Formerly, these open-air spas were available in only two forms: (1) a spa constructed with, and forming a part of, a swimming pool so that the water within could freely flow between the two, generally however, in only one direction, from the spa to the pool, and (2) a spa positioned in close proximity with an existing pool, but functioning separate and apart therefrom, an oftentimes requiring its own pump and filtering system. It was deemed to be desirable to combine a spa and swimming pool for use with a single pump and filtering system, but heretofore, unless a spa was constructed with a pool at the time of installation, it was required to be "added-on" to an existing pool. In so doing, the previous alternatives were: (1) to alter the configuration of the existing pool by removing part of a wall thereto, and installing a spa adjacent the pool and connecting the two by a hole or other passageway cut into the wall of the existing pool in order that water could flow freely back and forth between the pool and the added-on spa; or (2) to install a spa adjacent the swimming pool but separate therefrom thus avoiding the added expense and inconvenience of modifying the existing pool to incorporate the "add-on" spa.

The first alternative above, could be accomplished by either: (1) installing a preformed "add-on" spa of fiberglass or the like adjacent the existing, typically concrete, pool, or (2) modifying the existing pool to incorporate a concrete spa adjacent thereto, forming part of the original existing pool. The first option, that of installing a preformed fiberglass or the like spa to an existing concrete pool had accompanying obvious drawbacks inherent in attempting to provide a watertight seal between dissimilar materials, fiberglass and concrete. In addition, any break or gap in the integrity of the pool structural wall will almost always result in repeated or perpetual cracks in the wall originating at the union of the existing pool wall and the "add-on" spa due to the tremendous forces exerted on the wall by the volume of water within the pool. This is a constant source of frustration and expense to the pool owner. The second choice, is obviously more expensive than the first, thus a substantial deterrent to those wishing to install a recreational spa adjacent to, and in functional relationship with, an existing swimming pool.

The spill-over spa of the present invention is adapted to be used in conjunction with a pre-existing pool and provide communication between the pool and the spa without altering or otherwise modifying the existing pool in any manner, thereby preserving the integrity of the existing pool wall.

In accordance with the present invention, a spill-over type spa is provided, including a spillway over which water or other fluid contained therein will "spill-over" into a swimming pool or other reservior positioned adjacent therewith. The spa of the present invention is adapted to be installed adjacent an existing swimming pool without the necessity of altering or modifying the existing pool in any manner to accomodate such spa. A system of fluid flow conduit and fluid valves interconnect the spill-over spa, the swimming pool and the pump associated therewith in order that fluid within the spa and swimming pool may be returned to the spa and swimming pool, either separately or together.

BRIEF DESCRIPTION OF THE DRAWINGS

Other objects and advantages of the invention will become apparent upon reading the following detailed description and upon reference to the drawings, in which like reference characters are used throughout to desinate like parts.

While the invention will be described in connection with a preferred embodiment, it will be understood, that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
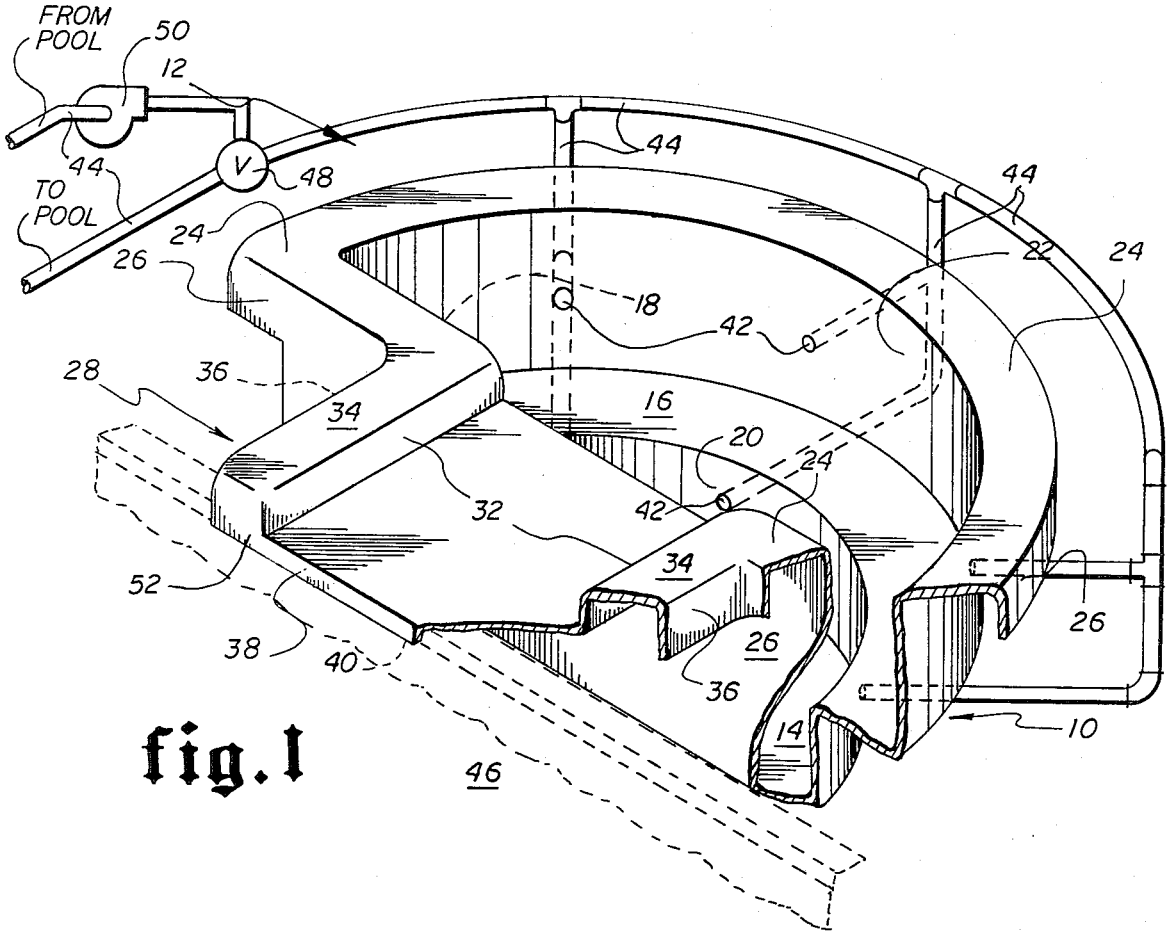
FIG. 1 is a perspective view of the spill-over spa of the present invention, showing the edge of an adjacent swimming pool, in phantom, illustrating a typical installation.
Figure 2:
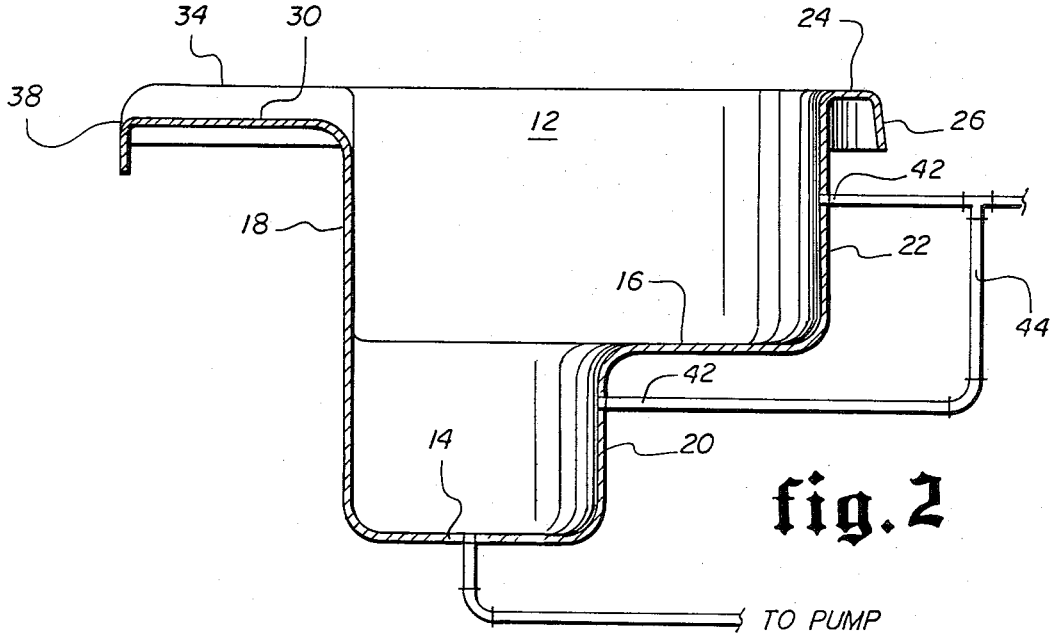
FIG. 2 is a vertical sectional view of the spill-over spa, the section taken along the plane of symmetry.

Turning now to FIG. 1, there is shown a spill-over spa of the present invention illustrated generally by the numeral 10. The spill-over spa 10 comprises, in large part, a body 12 having a floor 14, a semi-annular seat 16, sidewall means, comprising a front wall 18, a lower circular wall 20 and an upper circular wall 22, all defining an enclosure 23 for holding a body of water or other fluid therein.

The preferred embodiment of the present invention is a unitary molded fiberglass construction, having an upper peripheral edge portion 24, extending almost totally around the semi-spherical periphery of the spa 10. Molded with this top edge portion 24 is a side edge portion 26, which provides structural support for the unit when installed as will be described hereinbelow.

The spa 10 of the present invention includes a transition section generally illustrated at 28, which section comprises a lower surface 30, sidewalls 32, a top edge portion 34, an outer edge portion 36 and a spillway 38. This transition section 28 is integrally formed with the spa body 12 for permitting water or other fluid contained within the spa body to overflow through the transition section and into an adjacent pool or reservoir 46.

The transition section 28 includes a bottom edge surface 40, which surface engages the upper edge surface of the pool or reservoir. As best shown in the drawing, this bottom edge surface 40 extends around the periphery of the spa 10 and comprises a mounting edge by which the spa rests on a supporting surface, and by which the spa is guaged, leveled and supported adjacent the existing swimming pool in order to function properly.

As shown in the drawings, the preferred embodiment includes a number of fluid inlets 42 mounted with the upper and lower circular walls, 22 and 20 respectively, for introducing and directing the flow of heated fluid into the spa. These fluid inlets 42 are connected by interconnecting conduit 44 to the fluid pump 50, in a manner similar to the flow conduit connecting the swimming pool and the fluid pump. Also included in the present installation is a multi-positioned and multi-function fluid valve, or alternatively, a plurality of fluid valves, mounted with the fluid pump and interconnecting conduit for directing fluid flow from the pump to the spill-over spa and swimming pool and returning the fluid therefrom.

The transition section 28 may include an optional downwardly extending lip 52 depending from the outer edge portion 36 of the transition section lower surface 30. This lip 52 is designed to extend into the pool area sufficiently to prevent water or other fluid spilling over from the spa 10 into the pool 46 from running along the underside of the lower surface 30 and onto the upper peripheral edge of the pool or back along the spa exterior where it could erode the soil around the spa, causing loss of structural support and otherwise creating undesirable conditions. Alternatively, this underflow of water along the underside of the lower surface 30 could be prevented by imparting a slight incline to the lower surface sufficient to preclude the reverse flow of water back to the spa 10.

As those skilled in the art will readily appreciate, the spill-over spa of the present invention may be easily installed adjacent an existing swimming pool 46 without altering or otherwise modifying the structure of the pool itself or otherwise interfering with the integrity of the pool wall. The procedure for so doing is simply to dig a hole of sufficient size to accomodate the spill-over spa adjacent the existing pool, and to dig trenches for the placement of the interconnecting conduit 44 from the spill-over spa 10 to the fluid pump 50. Next, a support is constructed, typically of concrete and at a height equal to the peripheral edge of the existing swimming pool, and having an opening therein into which the body 12 of the spill-over spa 10 will fit when lowered into position. This support and opening therein are positioned adjacent the existing swimming pool to permit the transition section 28 of the spa 10 to extend into the swimming pool 46 sufficiently to permit fluid from within the spa passing through the transition section to spill-over into the swimming pool enclosure. With the spill-over spa 10 so positioned, interconnecting conduit is connected to the fluid inlets 42 of the spa, the fluid inlets of the swimming pool, the fluid valve or valves 48 and the fluid pump 50 as is customary in the trade.

Ths spill-over spa 10 of the present invention may be used in conjunction with, or independently of, the existing adjacent swimming pool 46. This is accomplished by adjusting the fluid valves 48 which control fluid flow from the pump to the spa fluid inlets 42 and the swimming pool and back therefrom to the pump. As is customary, a water heater is provided to heat water being injected into the spa 10 and hence, it may be desirable to recirculate this heated water within the spa independently of that in the adjacent swimming pool. This could be accomplished by closing the valve or valves interconnecting the pump 50 with the swimming pool 46, so that water flows from only the spa outlet to the pump 50 and back to the spa inlet 42 through the optional water heater. In this manner, the spill-over spa 10 operates in a conventional manner, independently of the adjacent swimming pool.

When it is desired to operate the spill-over spa 10 and the swimming pool 46 in conjunction with one another, valves 48 are accordingly adjusted to direct fluid from the fluid pump 50 to the spa fluid inlets 42, and to receive fluid from the swimming pool fluid outlets for recirculation through the pump and optional heater back to the spa 10. In this mode, fluid in the spa 10 reaches a predetermined maximum level and then overflows through the transition section 28 into the swimming pool 46 for recirculation back through the pump 50 and into the spa again.

The present invention has been described as having a semi-circular configuration with a flat, straight surface positioned adjacent a corresponding straight side of the swimming pool 46. Obviously, the shape is unimportant to the present invention so long as the spill-over spa is positioned in close proximity with the swimming pool to permit the transition section 28 to function as intended to permit the fluid within the spa 10 to spill-over into the adjacent swimming pool.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A device for installing adjacent an existing swimming pool for retaining a body of fluid for providing physical relaxation, therapy and enjoyment, said device communicating with the pool in a manner so as to preserve the integrity of the existing pool, said device comprising:

a body having a floor, a semi-annular seat, and sidewall means including a front wall, a lower circular wall, and an upper circular wall, said floor and sidewall means defining an enclosure for retaining a body of fluid, an upper peripheral edge portion connected to said sidewall means and including a side edge portion to provide structural support for the device when installed, and a transition section formed on and extending laterally outwardly from said body for permitting fluid within the device to flow from said device through said transition section and into the adjacent swimming pool, said transition section having a lower surface, a pair of sidewalls, a top edge portion joined to said upper peripheral edge portion of said sidewall means, an outer edge portion, and a spillway, said transition section lower surface including a downwardly extending lip depending from the edge of said transition section lower surface which engages an upper inner edge surface of the adjacent swimming pool to preclude the flow of fluid along the underside of the transition section.

2. The device as set forth in claim 1, including at least one fluid inlet mounted with said body for introducing and directing fluid flow into said body.

3. The device as set forth in claim 2, including means interconnecting said fluid inlet with a fluid pump, including:

a fluid valve for directing fluid flow to said device and said pool; and fluid conduit means interconnecting said device, pool and pump for providing fluid flow therebetween.

* * * * *